United States Patent [19]

Stevens

[11] Patent Number: 4,941,386

[45] Date of Patent: Jul. 17, 1990

[54] RESONATOR TUNING ADJUSTMENT FOR KEYBOARD PERCUSSION INSTRUMENTS

[75] Inventor: Leigh H. Stevens, Asbury Park, N.J.

[73] Assignee: The Selmer Company, Elkhart, Ind.

[21] Appl. No.: 355,784

[22] Filed: May 22, 1989

Related U.S. Application Data

[63] Continuation of Ser. No. 114,484, Oct. 28, 1987, abandoned.

[51] Int. Cl.[5] ..... G10D 13/08

[52] U.S. Cl. ..... 84/410; 84/359

[58] Field of Search ..... 84/349, 350, 402–405, 84/410

[56] References Cited

U.S. PATENT DOCUMENTS

| | | | |
|---|---|---|---|
| 1,173,782 | 2/1916 | Deagan | 84/410 |
| 2,414,656 | 1/1947 | Miller | 84/405 |
| 4,570,525 | 2/1986 | Suzuki | 84/410 |

*Primary Examiner*—Lawrence R. Franklin

*Attorney, Agent, or Firm*—Nixon & Vanderhye

[57] ABSTRACT

A tuning means for the resonators of keyboard percussion instruments, particularly the lower note resonators of marimbas. A threaded cap and collar provide pitch adjustment while a holding means maintains the adjustment so that vibration buzzing of the adjusting parts is prevented.

14 Claims, 2 Drawing Sheets

RESONATOR TUNING ADJUSTMENT FOR KEYBOARD PERCUSSION INSTRUMENTS

This is a continuation of application Ser. No. 07/114,484, filed Oct. 28, 1987, now abandoned.

BACKGROUND OF THE INVENTION

1. Field of the Invention

The invention relates generally to keyboard percussion instruments, such as marimbas and vibraphones, which have resonators associated with tuned bars.

2. Description of the Prior Art

In order to achieve the optimal relationship between each tuned bar and resonator, it is desirable to have the resonator respond sympathetically, or be tuned to, a certain pitch with respect to its associated tuned bar.

When a resonator is tuned very closely to the pitch of its associated tuned bar, the resulting tone (when the bar is struck) is loud, but relatively short in duration. With a slight amount of de-tuning of the resonator, the resulting tone is not so loud, but persists longer. The degree of de-tuning and whether the de-tuning is above or below the pitch of the tuned bar has a significant effect on the quality of the resultant tone.

Different musical selections call for different tonal responses. Therefore, it is desirable for the performing artist to be able to select or adjust the response of his instrument to achieve the tonal response he wants for the musical selection to be performed.

Prior art keyboard percussion instruments have provided for pitch adjustment of resonators, but the adjusting means has required the simultaneous use of tWo hands or has been otherwise inconvenient. While adjustable resonators have provided an advance over non-adjustable resonators, they have been unsatisfactory in that the performing artist has not been able to simultaneously tap the associated tuned bar of a resonator to be adjusted while at the same time adjusting that resonator. In other words, it has been necessary for the artist to make a small adjustment, strike the tuned bar to produce a tone, listen, make another adjustment, strike the bar again, etc. The present invention overcomes that problem.

SUMMARY OF THE INVENTION

The present invention provides a threaded or screw-type pitch adjustment for the resonators of a keyboard percussion instrument such as a marimba. The pitch adjustment mechanism of the present invention allows the player to simultaneously tap the bar associated with a resonator to repeatedly produce musical tones while adjusting the pitch of the resonator to produce the particular tonal effect desired. Holding means are provided to hold or maintain the adjustment means in position once the desired adjustment has been achieved.

DETAILED DESCRIPTION OF THE PREFERRED EMBODIMENTS

Figure 1:
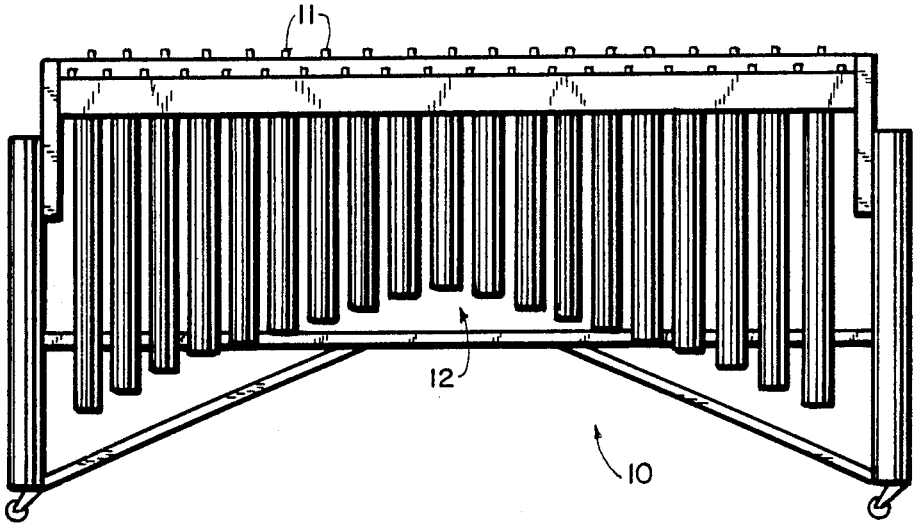
FIG. 1 is a rear view of a marimba without its tuned bars.

Referring now to FIG. 1, there is shown a somewhat schematic rear elevation view of a marimba 10 without its tuned bars. As is well known to persons skilled in the art, the tuned bars are supported by bar supports 11 and are struck with a mallet to produce musical tones of different pitch. Suspended beneath each tuned bar is a resonator tube that provides an air column approximately resonant to the pitch of its associated tuned bar.

The tuned bars of a marimba are customarily arranged in piano keyboard fashion so that we may, by analogy, refer to the "white key" bars and the "black key" bars. The associated resonators may be referred to by use of the same analogy. Therefore, we can say that the "white key" resonator assembly is illustrated at 12 in FIG. 1.

Figure 2:
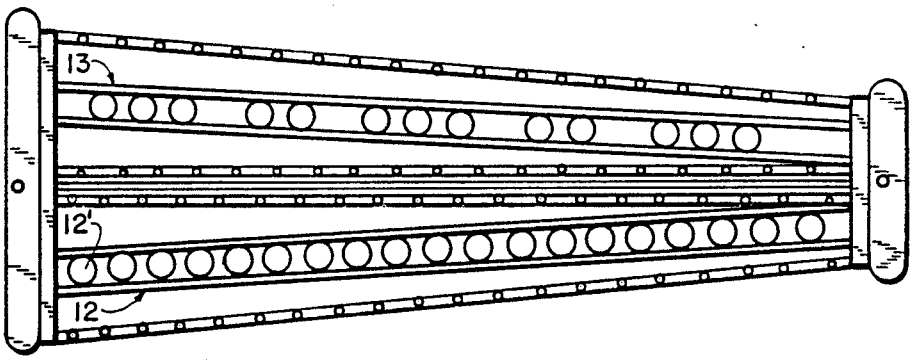
FIG. 2 is a top view of a marimba without its tuned bars.

Referring now to FIG. 2 there is shown a top view of the marimba of FIG. 1, again without tuned bars, so that the "white key" resonator assembly 12 and "black key" resonator assembly 13 may be clearly seen. Except for variations in diameter and length as required to produce the resonant air column for the associated tuned bar, all of the resonators are substantially structurally identical. It is known, however, that variations in humidity, temperature, etc. have more effect on the longer, larger diameter resonators for the lower pitched tuned bars than upon the shorter, smaller diameter resonators for the higher pitched tuned bars. Therefore, while some improvement or adjustment of response would be achieved by providing resonator tuning adjustment means for the higher pitched tones, the most dramatic and valuable results are achieved in the lower pitched tones, particularly the lower pitched tones of professional instruments which have a range as great as 4½ octaves.

Figure 3:
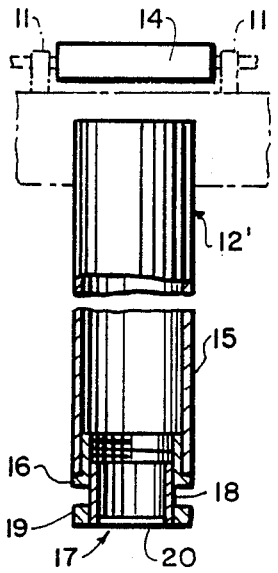
FIG. 3 is a schematic representation of a tuned bar and an associated resonator showing the resonator tuning means of the present invention.
Figure 4:
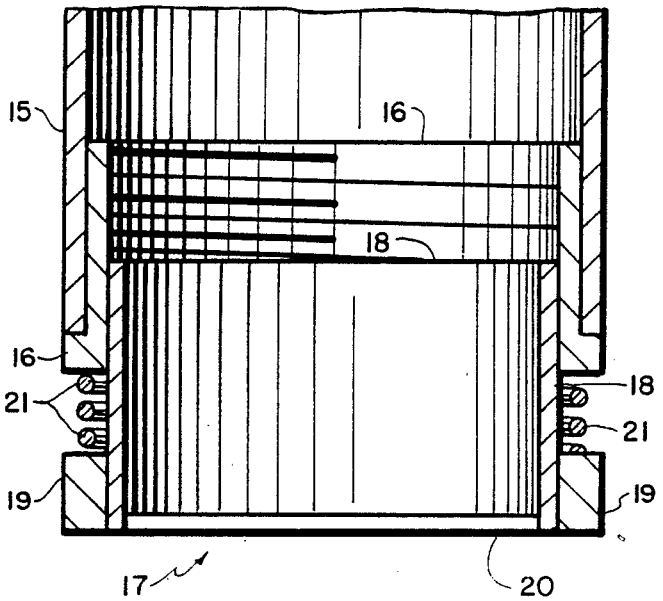
FIG. 4 is an enlarged cross-sectional view of the lower end of the resonator of FIG. 3 showing in detail the tuning means thereof and one embodiment of the holding means.

Only one resonator need be shown to illustrate the present invention, for example resonator 12' as shown in FIG. 2. FIG. 3 shows an enlarged diagrammatic representation of resonator 12' positioned beneath a tuned bar 14. The lower portion of resonator 12' is shown in cross-section where there can be seen the resonator tube 15, a threaded sleeve 16 and a threaded cap 17. In operation, the sleeve 16 is mounted in the lower end of tube 15 by means of an interference or press fit. Sleeve 16 may be considered to be a part of resonator tube 15, and may be integrally formed therewith or may be affixed by other means, e.g. adhesive bonding. Sleeve 16 is provided with internal or female threads to receive the external or male threads of cap 17. Cap 17 may have a tubular portion 18, a ring or flange portion 19 and a disc portion 20. While the prototypes for this assembly have been fabricated as illustrated in FIG. 4, with the disc portion 20 being fillet welded to the tubular portion 18 and the ring or flange portion affixed by means of an interference or press fit, it is contemplated that the cap may be manufactured as an integral piece by forging or casting. It will be seen that rotation of the cap 17 with respect to the sleeve 16 will advance the cap into or out of resonator tube 15 depending upon the direction of rotation. As the cap is screwed out of resonator tube 15, the air column is lengthened and the resonant pitch of the air column is lowered. Conversely, if the cap 17 is rotated in the opposite direction so that it advances into the resonator tube, the length of the air column is shortened and the resonate resonant pitch thereof is raised.

It is axiomatic that loose or poor fitting threaded couplings are less expensive than smooth, tight fitting threaded couplings. Loose threaded couplings, however, cannot be used for tuning adjustment means because the vibrating air column will cause any loose element to vibrate and produce a very undesirable buzzing sound. Thus, it is essential that the threads be smooth-running and have no "shake" so that this undesirable buzzing sound will be avoided.

It is also necessary that the threads provide a reasonable pneumatic seal between the cap 17 and the resonator tube 15. This necessity arises from the need to have highly efficient acoustical resonators. As any organist or wind instrument player can attest, a rather small air leak can very adversely affect tonal response.

There are thus, conflicting considerations in the detailed design and construction for a resonator tuning adjustment means. The cooperating parts must fit tightly to prevent buzzing and to provide a good pneumatic seal. The tight fitting relationship may also provide for holding the adjustment once it is made. On the other hand, if the adjustment is to be capable of being quickly and easily made, the parts must not fit together so tightly that they cannot be easily and quickly adjusted. Naturally, it is desirable to provide a tuning adjustment means that does not require the artist to use tools.

One solution to this problem with which I have achieved some success is to place a viscous material interposed between the mating threads of cap 17 and sleeve 16. The viscous material, such as automobile chassis lube grease, or wheel bearing lubricant, simultaneously prevents vibration between the cap and sleeve, provides a good pneumatic seal, and permits easy rotation of the cap with respect to the sleeve. Not enough time or operation under varying conditions has been experienced, however, to say whether this will be a long-term solution. Changes in the sealing ability or lubricity of the material may affect its performance. The short-term performance, however, has been good.

It is contemplated that an additional holding means to maintain a desired adjustment may be required. One such holding means is a helical spring 21 as illustrated in FIG. 4. Spring 21 is loaded in compression between flange 19 and sleeve 16, and thereby provides a frictional holding force that will oppose rotation of cap 17 with respect to sleeve 16.

Figure 5:
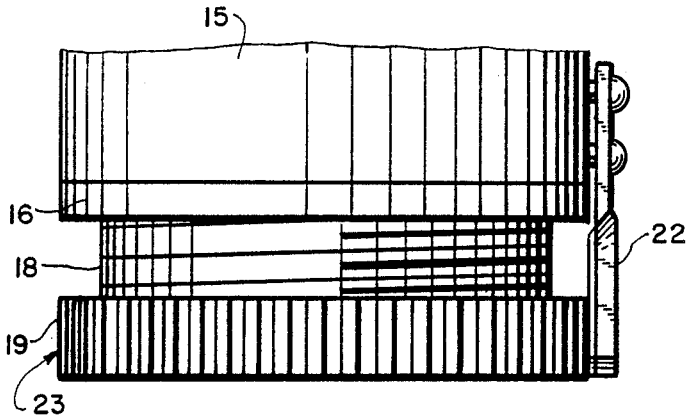
FIG. 5 is an enlarged view of the lower end of the resonator of FIG. 3 showing the tuning means thereof and an alternate embodiment of the holding means.
Figure 6:
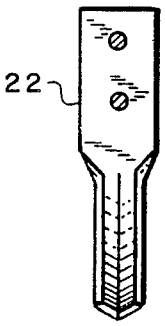
FIG. 6 is a side view of the holding element for the holding means illustrated in FIG. 5.

Another embodiment of the holding means is illustrated in FIG. 5 wherein flange 19 is provided with knurling or the like about its circumference and is engaged by a finger type spring member 22 affixed to the side of tube 15, or sleeve 16. Spring member 22 may, of course, take many different shapes, the particular shape shown in FIGS. 5 and 6 being merely illustrative. It is only necessary that spring member 22 engage some portion of cap 17, with sufficient frictional force to prevent undesired rotation. Further experimentation may show that the knurling 23 is not necessary.

Having read the foregoing specification with reference to the drawing and the numerous parts illustrated therein, a person skilled in the art of designing or manufacturing keyboard percussion musical instruments will readily understand the structure and operation of the present invention. The foregoing description, however, while setting forth the best mode contemplated by the inventor for making and practicing the present invention, should be considered as illustrative and not restrictive in nature. It is intended that modifications and variations of the above-described invention that fall within the spirit thereof shall be covered by the following claims.

What is claimed is:

1. Tuning adjustment means for a resonator tube of a keyboard percussion instrument comprising a cap having a tubular portion threadedly received within the lower end of said resonator tube whereby rotation of said cap in one direction advances said cap into said resonator tube to shorten the air column thereof and rotation of said cap in the opposite direction moves said cap outwardly of said resonator tube to lengthen the air column thereof, sealing means for providing a pneumatic seal between the mating threaded portions of said resonator tube and said cap, and holding means for holding said cap in rotational position with respect to said resonator tube, said sealing means comprising mating threads on said cap and said resonator tube and a viscous material interposed therebetween.

2. Tuning adjustment means for a resonator tube of a keyboard percussion instrument comprising a cap having a tubular portion threadedly received within the lower end of said resonator tube whereby rotation of said cap in one direction advances said cap into said resonator tube to shorten the air column thereof and rotation of said cap in the opposite direction moves said cap outwardly of said resonator tube to lengthen the air column thereof, sealing means for providing a pneumatic seal between the mating threaded portions of said resonator tube and said cap, and holding means for holding said cap in rotational position with respect to said resonator tube, said sealing means and said holding means comprising tight-fitting, smooth running mating threads on said cap and said resonator tube and a viscous material interposed therebetween.

3. Tuning adjustment means for a resonator tube of a keyboard percussion instrument comprising a cap having a tubular portion threadedly received within the lower end of said resonator tube whereby rotation of said cap in one direction advances said cap into said resonator tube to shorten the air column thereof and rotation of said cap in the opposite direction moves said cap outwardly of said resonator tube to lengthen the air column thereof, sealing means for providing a pneumatic seal between the mating threaded portions of said resonator tube and said cap, and holding means for holding said cap in rotational position with respect to said resonator tube, wherein said holding means comprises spring means operative between said resonator tube and said cap for providing a frictional holding force for opposing rotation of said cap with respect to said resonator tube.

4. The tuning adjustment means according to claim 3 in combination with said keyboard percussion instrument and said resonator tube wherein said instrument includes a tuned bar in association with said tube, said cap having a disk portion spaced lengthwise from the threads on said tubular portion thereof closing the end of said tube, said disk portion extending substantially normal to the tubular portion at a location that provides an air column in said resonator tube approximately resonant to the pitch of said associated tuned bar.

5. The invention of claim 3, wherein said spring means comprises a helical spring positioned between the lower end of said resonator tube and said cap.

6. The invention of claim 3, wherein said spring means comprises a finger type spring member affixed to said resonator tube and bearing against a portion of said cap.

7. The invention of claim 6, wherein said portion of said cap is knurled.

8. In a resonator tube of a percussion instrument, the improvement comprising:

an open lower end portion of said resonator tube having a pattern of threads;

a cap for closing said open end portion, said cap having a tubular portion with a pattern of threads for mating with said resonator tube threads whereby rotation of said cap in one direction advances said cap into said resonator tube to shorten said air column and rotation of the cap in the other direction moves said cap outwardly of said resonator tube to lengthen said air column;

said resonator tube enclosing a vibrating air column during resonator operation which induces a vibration in said resonator tube and said cap; and said mating threads being dimensioned for providing a pneumatic seal across said threads between said cap and said resonator tube and for allowing manual rotation of said cap, while holding means for preventing rotation of said cap caused by said vibration, comprising spring means operative between said resonator tube and said cap for providing a frictional holding force for opposing rotation of said cap with respect to said resonator tube.

9. The invention of claim 8 wherein said spring means comprises a helical spring positioned between the lower end of said resonator tube and said cap.

10. The invention of claim 8 wherein said spring means comprises a finger type spring member affixed to said resonator tube and bearing against a portion of said cap.

11. The invention of claim 10 wherein said portion of said cap is knurled.

12. The resonator tube according to claim 8 in combination with said percussion instrument having said resonator tube and an associated tuned bar, wherein said cap has a disk portion spaced lengthwise from the threads on said tubular portion thereof closing the end of said tube, said disk portion extending substantially normal to the tubular portion at a location that provides an air column in said resonator tube approximately resonant to the pitch of an associated tuned bar.

13. In a resonator tube of a percussion instrument, the improvement comprising:

an open lower end portion of said resonator tube having a pattern of threads, a cap for closing said open end portion, said cap having a tubular portion with a pattern of threads for mating with said resonator tube threads whereby rotation of said cap in one direction advances said cap into said resonator tube to shorten said air column and rotation of the cap in the other direction moves said cap outwardly of said resonator tube to lengthen said air column;

said resonator tube enclosing a vibrating air column during resonator operation which induces a vibration in said resonator tube and said cap; and said mating threads being dimensioned for providing a pneumatic seal across said threads between said cap and said resonator tube and for allowing manual rotation of said cap while preventing rotation of said cap caused by said vibration, said pneumatic seal comprising mating threads on said cap and said resonator tube and a viscous material interposed therebetween.

14. In a resonator tube of a percussion instrument, the improvement comprising:

an open lower end portion of said resonator tube having a pattern of threads;

a cap for closing said open end portion, said cap having a tubular portion with a pattern of threads for mating with said resonator tube threads whereby rotation of said cap in one direction advances said cap into said resonator tube to shorten said air column and rotation of the cap in the other direction moves said cap outwardly of said resonator tube to lengthen said air column;

said resonator tube enclosing a vibrating air column during resonator operation which induces a vibration in said resonator tube and said cap; and said mating threads being dimensioned for providing a pneumatic seal across said threads between said cap and said resonator tube and for allowing manual rotation of said cap while preventing rotation of said cap caused by said vibration, said pneumatic seal comprising tight-fitting, smooth running mating threads on said cap and said resonator tube and a viscous material interposed therebetween.

* * * * *